US008044011B2

(12) United States Patent
Warkotsch et al.

(10) Patent No.: US 8,044,011 B2
(45) Date of Patent: Oct. 25, 2011

(54) CLEANING AGENTS COMPRISING A POLYCARBONATE-, POLYURETHANE-, AND/OR POLYUREA-POLYORGANOSILOXANE COMPOUND

(75) Inventors: Nadine Warkotsch, Duesseldorf (DE); Marc-Steffen Schiedel, Duesseldorf (DE); Johannes Zipfel, Duesseldorf (DE); Arnd Kessler, Monheim am Rhein (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 74 days.

(21) Appl. No.: 12/567,090

(22) Filed: Sep. 25, 2009

(65) Prior Publication Data

US 2010/0016203 A1 Jan. 21, 2010

Related U.S. Application Data

(63) Continuation of application No. PCT/EP2008/053997, filed on Apr. 3, 2008.

(30) Foreign Application Priority Data

Apr. 3, 2007 (DE) ..... 10 2007 016 389
May 21, 2007 (DE) ..... 10 2007 023 875
Aug. 14, 2007 (DE) ..... 10 2007 038 482

(51) Int. Cl.
*C11D 9/36* (2006.01)

(52) U.S. Cl. ..... 510/222; 510/220; 510/221; 510/226; 510/228; 510/229; 510/231

(58) Field of Classification Search ..... 510/220, 510/221, 222, 226, 228, 229, 231
See application file for complete search history.

(56) References Cited

U.S. PATENT DOCUMENTS

| | | | | |
|---|---|---|---|---|
| 3,367,920 | A | 2/1968 | Wasserman et al. | |
| 3,893,929 | A | 7/1975 | Basadur | |
| 4,000,093 | A | 12/1976 | Nicol et al. | |
| 4,116,885 | A | 9/1978 | Derstadt et al. | |
| 4,136,038 | A | 1/1979 | Pracht et al. | |
| 4,174,305 | A | 11/1979 | Burns et al. | |
| 4,201,824 | A | 5/1980 | Lagasse et al. | |
| 4,664,839 | A | 5/1987 | Rieck | |
| 5,534,182 | A | 7/1996 | Kirk et al. | |
| 5,622,926 | A | 4/1997 | Schade et al. | |
| 5,643,581 | A * | 7/1997 | Mougin et al. | 424/401 |
| 6,395,265 | B1 * | 5/2002 | Mougin et al. | 424/70.12 |
| 2003/0158064 | A1 | 8/2003 | Kessler et al. | |
| 2003/0198819 | A1 * | 10/2003 | Reusmann et al. | 428/447 |
| 2004/0034911 | A1 | 2/2004 | Day | |
| 2007/0092656 | A1 * | 4/2007 | Keul et al. | 427/400 |
| 2008/0075683 | A1 * | 3/2008 | Herzig et al. | 424/70.12 |
| 2009/0232752 | A1 * | 9/2009 | Carson et al. | 424/59 |
| 2010/0011513 | A1 | 1/2010 | Warkotsch et al. | |
| 2010/0011519 | A1 | 1/2010 | Warkotsch et al. | |
| 2010/0016206 | A1 | 1/2010 | Warkotsch et al. | |
| 2010/0022427 | A1 | 1/2010 | Warkotsch et al. | |
| 2010/0022428 | A1 | 1/2010 | Warkotsch et al. | |
| 2010/0028270 | A1 * | 2/2010 | Nguyen-Kim | 424/47 |

FOREIGN PATENT DOCUMENTS

| | | | |
|---|---|---|---|
| DE | 1617141 | A1 | 10/1965 |
| DE | 2200911 | A1 | 1/1971 |
| DE | 2253063 | A1 | 10/1971 |
| DE | 2412837 | | 10/1974 |
| DE | 2655551 | A1 | 6/1977 |
| DE | 2846984 | A1 | 5/1979 |
| DE | 2857292 | A1 | 2/1980 |
| DE | 3324258 | A1 | 1/1984 |
| DE | 42 44 386 | A1 | 6/1994 |
| DE | 10037126 | A1 | 2/2002 |
| DE | 100 50 622 | A1 | 5/2002 |
| DE | 103 57 232 | B3 | 6/2005 |
| EP | 0164514 | A1 | 11/1984 |
| EP | 0 185 427 | | 6/1986 |
| EP | 0 213 739 | A2 | 3/1987 |
| EP | 0 300 305 | A2 | 7/1987 |
| EP | 0 241 984 | A2 | 10/1987 |
| EP | 0 241 985 | A2 | 10/1987 |
| EP | 0 213 729 | | 11/1987 |
| EP | 0 213 730 | | 11/1987 |
| EP | 2 53 567 | A1 | 1/1988 |
| EP | 0 271 312 | A2 | 6/1988 |
| EP | 2 72 033 | A2 | 6/1988 |
| EP | 0 274 907 | A1 | 7/1988 |
| EP | 357280 | A2 | 3/1990 |
| EP | 0 634 486 | A1 | 1/1995 |
| EP | 1 541 568 | A1 | 6/2005 |
| GB | 1154730 | | 6/1969 |
| GB | 1377092 | | 12/1974 |
| GB | 2007692 | A | 5/1979 |
| GB | 1578930 | | 11/1980 |
| GB | 2165856 | | 4/1986 |
| WO | WO-97/09369 | A | 3/1997 |
| WO | WO 99/41347 | | 8/1999 |
| WO | WO 00/77138 | A1 | 12/2000 |
| WO | WO 03/035712 | A1 | 5/2003 |
| WO | WO 03/042264 | A2 | 5/2003 |
| WO | WO 03/095530 | A1 | 11/2003 |
| WO | WO 2005/042684 | A1 | 5/2005 |
| WO | WO 2005/058863 | A1 | 6/2005 |
| WO | WO 2006/005358 | A1 | 1/2006 |
| WO | WO 2006/029794 | A1 | 3/2006 |
| WO | WO 2006/069742 | A1 | 7/2006 |
| WO | WO 2006/127882 | A2 | 11/2006 |

* cited by examiner (Continued)

OTHER PUBLICATIONS

International Search Report for Priority Application PCT/EP2008/053997.

*Primary Examiner* — Charles Boyer
(74) *Attorney, Agent, or Firm* — RatnerPrestia

(57) ABSTRACT

The invention relates to machine dishwashing agents containing specific polycarbonate-, polyurethane-, and/or polyurea-polyorganosiloxane compounds or precursor compounds thereof of the reactive cyclic carbonate and urea type which help to avoid the formation of water spots and filming after the use of the agents and accelerate the drying of dishes.

21 Claims, No Drawings

CLEANING AGENTS COMPRISING A POLYCARBONATE-, POLYURETHANE-, AND/OR POLYUREA-POLYORGANOSILOXANE COMPOUND

CROSS-REFERENCE TO RELATED APPLICATIONS

This application is a continuation under 35 U.S.C. §§120 and 365(c) of International Application PCT/EP2008/053997, filed on Apr. 3, 2008, and published as WO 2008/119834 on Oct. 9, 2008. This application also claims priority under 35 U.S.C. §119 of DE 10 2007016389.6 filed Apr. 3, 2007, DE 10 2007023875.6, filed May 21, 2007, and DE 10 2007038482.5, filed Aug. 14, 2007. The disclosures of PCT/EP2008/053997, DE 10 2007016389.6, DE 10 2007023875.6, and DE 10 2007038482.5 are hereby incorporated by reference in their entirety for all purposes.

FIELD OF THE INVENTION

The present patent application relates to cleaning agents for automatic cleaning of dishes.

DISCUSSION OF THE RELATED ART

Higher demands are often made of automatic-washed dishes today than of hand-washed dishes. After an automatic cleaning, dishes should not only be completely free of food residues, but also should not have whitish spots based on water hardness or other mineral salts, for example, which are due to drops of water drying in the absence of wetting agent.

Dishes are often still wet after automatic dishwashing. If the dishes are not being immediately removed from the machine and dried with a dishtowel but instead are left to stand in the machine, this results in unattractive lime spots on dishes, in particular plastic dishes, which then can be removed only by polishing the dishes with a cloth. There has not previously been a satisfactory solution for this problem. Automatic dishwashing agents usually contain so-called clear rinse surfactants which are supposed to prevent the formation of unattractive lime spots and lime deposits. These clear rinse surfactants usually have different effects on various hydrophilic/hydrophobic surfaces. In particular, however, plastic surfaces are most critical and often still come out of the machine with lime spots or deposits.

BRIEF SUMMARY OF THE INVENTION

It has now surprisingly been found that certain polycarbonate-, polyurethane- and/or polyurea-polyorganosiloxane compounds or precursor compounds of the reactive cyclic carbonate and urea type usable in their synthesis have an excellent clear rinse effect in an automatic dishwashing agent as well as leading to a significantly better drying of the dishes.

The subject of the present invention is therefore in a first embodiment an automatic dishwashing agent containing a polycarbonate-, polyurethane- and/or polyurea-polyorganosiloxane compound, comprising at least one structural element of Formula (I):

$$—Y-A-(C{=}O)-A- \quad (I)$$

where each A is selected, independently, from S, O and $NR^1$,

Y is selected from divalent to polyvalent, in particular tetravalent, linear, cyclic or branched, saturated, unsaturated or aromatic, substituted or unsubstituted hydrocarbon radicals with up to 1000 carbon atoms (not counting the carbon atoms of a polyorganosiloxane unit that is optionally also included), which may contain one or more groups selected from —O—, —(CO)—, —NH—, —$NR^2$—, —($N^+R^2R^3$)— and a polyorganosiloxane unit with 2 to 1000 silicon atoms, $R^1$ is hydrogen or a linear, cyclic or branched, saturated, unsaturated or aromatic hydrocarbon radical with up to 40 carbon atoms, which may contain one or more groups selected from —O—, —(CO)—, —NH— and —$NR^2$—, $R^2$ is a linear, cyclic or branched, saturated, unsaturated or aromatic hydrocarbon radical with up to 40 carbon atoms, which may contain one or more groups selected from —O—, —(CO)— and —NH—, $R^3$ is a linear, cyclic or branched, saturated, unsaturated or aromatic hydrocarbon radical with up to 100 carbon atoms, which may contain one or more groups selected from —O—, —(CO)— and —NH— or is a divalent radical, which forms cyclic structures within the radical Y, or one or both radicals A vicinal to Y together with the radical Y between them may form a heterocyclic radical containing nitrogen, and not all the radicals A and/or Y and/or $R^1$ and/or $R^2$ and/or $R^3$ indicated in Formula (I) must be the same in the entire compound, with the provision that at least one of the radicals Y in the entire compound is a polyorganosiloxane unit with 2 to 1000 silicon atoms or the acid addition compound and/or salt thereof.

Compounds of general formula (I) can be obtained by reacting diisocyanates, bischloroformic acid esters and/or amides or phosgene with thiols, alcohols or amines containing the structural element Y. To obtain polymer structures, these starting compounds containing the structural element Y have at least two of the aforementioned functional groups. Compounds that are monofunctional but otherwise correspond to structural element Y may be considered as end groups.

Of preferred polycarbonate- and/or polyurethane-polyorganosiloxane compounds, there are those containing at least one structural element of Formula (II) or (III):

$$-A-Y-A-(CO)—O—Z—(CHOH)—Z—O—(CO)— \quad (II)$$

$$-A-Y-A-(CO)—O—(CHCH_2OH)—Z—O—(CO)— \quad (III)$$

in which A and Y have the meanings given above, and

Z is selected from the divalent, linear, cyclic or branched, saturated or unsaturated, optionally substituted hydrocarbon radicals with 1 to 12 carbon atoms. These structural elements can be obtained by ring opening of cyclic carbonates (carbonic acid esters of vicinal diols) with thiols, alcohols or amines containing the structural element Y.

The polycarbonate-, polyurethane- and/or polyurea-polyorganosiloxane compound preferably contains the structural element of Formula (I) several times in series, where the corresponding radicals A and/or Y and/or Z and/or $R^1$ and/or $R^2$ and/or $R^3$, which occur multiple times, may be the same or different.

The term "acid addition compound" denotes a salt-like compound, which can be obtained by protonation of basic groups in the molecule, in particular the amino groups that are optionally present, e.g., by reaction with organic or inorganic acids. The acid addition compounds may be used as such or may optionally be formed under the conditions of use of the compounds defined above.

If the polycarbonate-, polyurethane- and polyurea-polyorganosiloxane compound contains —($N^+R^2R^3$)— groups, then conventional counter anions, e.g., halide, hydroxide, sulfate, carbonate, are present in an amount sufficient to ensure charge neutrality.

The polyorganosiloxane structural element present in the polycarbonate-, polyurethane- and/or polyurea-polyorganosiloxane corn pounds is preferably the structure $—(SiR^4{}_2O)_p—(SiR^4{}_2)—$, where $R^4$ is a linear, cyclic or branched, saturated, unsaturated or aromatic hydrocarbon radical with up to 20 carbon atoms, and p=1 to 999. The polycarbonate-, polyurethane- and polyurea-polyorganosiloxane compounds preferably contain on the average at least two, in particular at least three of the aforementioned polyorganosiloxane structural elements. $R^4$ is preferably a linear or cyclic or branched, saturated or unsaturated or aromatic $C_1$ to $C_{20}$, in particular a $C_1$ to $C_9$ hydrocarbon radical, especially preferably methyl or phenyl, and p is in particular 1 to 199, especially preferably 1 to 99. In a preferred embodiment, all radicals $R^4$ are the same.

Preferred polycarbonate-, polyurethane- and/or polyurea-polyorganosiloxane compounds used according to the invention are linear, i.e., all Y units in the structural element of formula (I) are divalent radicals. However, branched compounds may also be covered by the present invention, in which at least one of the radicals Y is trivalent or polyvalent, preferably tetravalent, so that branched structures with linear repeating structures are formed from structural elements of Formula (I).

In another embodiment, at least one of the Y units according to the structural element of Formula (I) has a group $—NR^2—$ and at least one of the Y units according to the structural element of Formula (I) has a group $—(N^+R^2R^3)—$ in the polycarbonate-, polyurethane- and/or polyurea-polyorganosiloxane compound used according to the invention. $R^2$ and $R^3$ here are preferably methyl groups.

Another embodiment relates to the multiple regular occurrences of —O— groups in at least one of the units Y, $R^1$, $R^2$ and/or $R^3$ according to the structural element of formula (I), preferably in the form of oligoethoxy groups and/or oligopropoxy groups, whereby their degrees of oligomerization are preferably in the range from 2 to 60.

In another preferred embodiment, oligoethyleneimine groups whose degrees of oligomerization are in the range of 10 to 150,000 are present in at least one of the units Y, $R^1$, $R^2$ and/or $R^3$ according to the structural element of formula (I).

Reactive cyclic carbonates and ureas, processes for synthesis of same and reaction of same with polymer substrates are described in International Patent Application WO 2005/058863. It has now surprisingly been found that not only do the polycarbonate- and/or polyurethane-polyorganosiloxane compounds of the type indicated above, which are accessible from same, improve the clear rinse effect and also the drying, but also the reactive cyclic carbonates and ureas themselves and/or the polymers obtainable from same by reaction with polymer substrates have the desired effect.

Another subject of the invention is therefore the use of compounds of the general Formula (IV) or (V):

IV

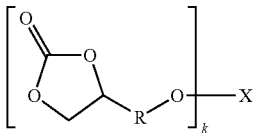

-continued

V

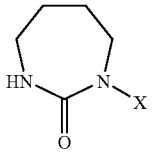

in which

R stands for $C_1$-$C_{12}$ alkylene, k stands for a number greater than 0,

X stands for $CO—CH=CH_2$, $CO—C(CH_3)=CH_2$, CO—O-aryl, $C_2$-$C_6$-alkylene-$SO_2—CH=CH_2$ or $CO—NH—R^1$; and $R^1$ stands for $C_1$-$C_{30}$-alkyl, $C_1$-$C_{30}$-haloalkyl, $C_1$-$C_{30}$-hydroxyalkyl, $C_1$-$C_6$-alkyloxy-$C_1$-$C_{30}$-alkyl, $C_1$-$C_6$-alkylcarbonyloxy-$C_1$-$C_{30}$-alkyl, amino-$C_1$-$C_{30}$-alkyl, mono- or di($C_1$-$C_6$-alkyl)amino-$C_1$-$C_{30}$-alkyl, ammonio-$C_1$-$C_{30}$-alkyl, polyoxyalkylene-$C_1$-$C_{30}$-alkyl, polysiloxanyl-$C_1$-$C_{30}$-alkyl, (meth)-acryloyloxy-$C_1$-$C_{30}$-alkyl, sulfono-$C_1$-$C_{30}$-alkyl, phosphono-$C_1$-$C_{30}$-alkyl, di($C_1$-$C_6$-alkyl) phosphono-$C_1$-$C_{30}$-alkyl, phosphonato-$C_1$-$C_{30}$-alkyl, di($C_1$-$C_6$-alkyl)-phosphonato-$C_1$-$C_{30}$-alkyl or a saccharide radical, such that X in Formula (IV) has this meaning only when k stands for 1, or X stands for (i) the radical of a polyamine to which the part of the formula in parentheses is bound via (CO)NH groups, or (ii) a polymer structure to which the formula part in parentheses is bound via (CO), NH—$C_2$-$C_6$-alkylene-O(CO) or (CO)—O—$C_2$-$C_6$-alkylene-O(CO) groups, or (iii) a polymer structure to which the formula part in parentheses is bound via (CO)-polysiloxanyl-$C_1$-$C_{30}$-alkyl groups, when k stands for a number greater than 1, and/or contains polymers which are obtainable by reaction of a polymer substrate having functional groups, which are selected from hydroxyl groups, primary and secondary amino groups, with a compound of general Formula (IV) or (V).

The polymer substrates suitable in conjunction with the aspect of the invention mentioned last include in particular polyvinyl alcohols, polyalkyleneamines, such as polyethyleneimines, polyvinylamines, polyallyl-amines, polyethylene glycols, chitosan, polyamide-epichlorohydrin resins, polyaminostyrenes, polysiloxanes substituted with aminoalkyl groups in terminal position or as side groups, e.g., polydimethylsiloxanes, peptides, polypeptides and proteins as well as mixtures thereof. Especially preferred substrates are selected from polyethyleneimines with molecular weights in the range of 5000 to 100,000 in particular 15,000 to 50,000, compounds of formula $NH_2—[CH_2]_m—(Si(CH_3)_2O)_n—Si(CH_3)_2—[CH_2]_o—R'$, where m=1 to 10, preferably 1 to 5, especially preferably 1 to 3, where n=1 to 50, preferably 30 to 50, where o=0 to 10, preferably 1 to 5, especially preferably 1 to 3, and where R'=H, $C_{1-22}$ alkyl, an amino group or an ammonium group, and/or compounds of formula $NH_2—[CH(CH_3)—CH_2O_l]—[CH_2—CH_2O]_m—[CH_2—CH(CH_3)O]_n—R''$, where l, m and n, independently of one another, denote numbers from 0 to 50, with the provision that the sum l+m+n=5 to 100, in particular 10 to 50, preferably 10 to 30, especially preferably 10 to 20, and R''=H, a $C_{1-22}$ alkyl, $C_{1-22}$ aminoalkyl or $C_{1-22}$ ammonium alkyl group and mixtures thereof.

Of the polymers, those that are especially preferred are obtainable by reaction of the polymer substrate with a compound of general Formula (IV), where k=1, or of general Formula (V). Also preferred are polymers obtainable by reaction of the polymer substrate with the same molar amounts of the compound of general Formula (IV), where k=1, or of general Formula (V), based on the amount of hydroxyl groups, primary and secondary amino groups.

The compound of Formula (IV) is preferably selected from 4-phenyloxycarbonyloxymethyl-2-oxo-1,3-dioxolane,
4-(4-phenyloxycarbonyloxy)butyl-2-oxo-1,3-dioxolane,
2-oxo-1,3-dioxolan-4-yl-methyl acrylate,
2-oxo-1,3-dioxolan-4-yl-methyl methacrylate,
4-(2-oxo-1,3-dioxolan-4-yl)butyl acrylate,
4-(2-oxo-1,3-dioxolan-4-yl)butyl methacrylate and
4-(vinylsulfonylethyloxy)butyl-2-oxo-1,3-dioxolane.

Inventive agents preferably contain 0.01 wt % to 5 wt %, in particular 0.5 wt % to 3 wt % of the active ingredient described here (the polycarbonate-, polyurethane- and/or polyurea-polyorganosiloxane compound, the reactive cyclic carbonate ore reactive cyclic urea and/or the polymer obtainable from the latter by reaction with a polymer substrate).

Inventive agents may also comprise all ingredients traditionally contained in such agents, in particular builder(s), bleaching agent(s) and surfactant(s), if they do not interact in an unreasonable manner negatively with the inventive active substance during storage and/or use of the agent.

Inventive automatic dishwashing agents preferably contain nonionic surfactant, in particular nonionic surfactants of the general formula $R^6$—$CH(OH)CH_2O$-$(AO)_w$-$(A'O)_x$-$(A''O)_y$-$(A'''O)_z$—$R^7$, in which $R^6$ stands for a linear or branched, saturated or mono- or polyunsaturated $C_{6-24}$ alkyl or alkenyl radical;
$R^7$-stands for a linear or branched hydrocarbon radical with 2 to 26 carbon atoms;
A, A', A'' and A''', independently of one another, stand for a radical from the group —$CH_2CH_2$, —$CH_2CH_2$—$CH_2$, —$CH_2CH_2(CH_3)$, —$CH_2$—$CH_2$—$CH_2$—$CH_2$, —$CH_2$—$CH(CH_3)$—$CH_2$—, —$CH_2$—$CH(CH_2CH_3)$,
w, x, y and z, independently of one another, stand for values between 0.5 and 120, where x, y and/or z may also be 0.

Preferred inventive automatic dishwashing agents have a nonionic surfactant content by weight of 1 wt % to 10 wt %, preferably 2 wt % to 8 wt % and especially 2 wt % to 6 wt %.

Especially advantageous with respect to the cleaning performance and clear rinse performance are nonionic surfactants of the general formula $R^6$—$CH(OH)CH_2O$-$(AO)_w$-$(A'O)_x$—$R^7$ in which $R^6$ stands for a linear or branched, saturated or mono- and/or polyunsaturated $C_{6-24}$ alkyl or alkenyl radical;
$R^7$ stands for a linear or branched hydrocarbon radical with 2 to 26 carbon atoms;
A and A', independently of one another, stand for a radical from the group $CH_2CH_2$, —$CH_2CH_2$—$CH_2$, —$CH_2CH_2(CH_3)$, and
w and x, independently of one another, stand for values between 0.5 and 120.

Automatic dishwashing agents that are especially preferred are those in which the nonionic surfactant has the general formula $R^6$—$CH(OH)CH_2O$-$(AO)_w$-$(A'O)_x$—$R^7$ in which $R^6$ stands for a linear or branched, saturated or mono- and/or polyunsaturated $C_{6-24}$ alkyl or alkenyl radical;
$R^7$ stands for a linear or branched hydrocarbon radical with 2 to 26 carbon atoms;
A stands for a $CH_2CH_2$ radical and A' stands for a —$CH_2CH_2$—$CH_2$ or a —$CH_2$—$CH(CH_3)$, and
w stands for values between 2 and 40, while x stands for values between 0.5 and 2.

In another preferred embodiment, the nonionic surfactant has the general formula $R^6$—$CH(OH)CH_2O$-$(AO)_w$—$R^7$ in which $R^6$ stands for a linear or branched, saturated or mono- and/or polyunsaturated $C_{6-24}$ alkyl or alkenyl radical;
$R^7$ stands for a linear or branched hydrocarbon radical with 2 to 26 carbon atoms;
A stands for a radical from the group $CH_2CH_2$, —$CH_2CH_2$—$CH_2$, —$CH_2$—$CH(CH_3)$ and
w stands for values between 1 and 120, preferably 10 to 80, in particular 20 to 40.

The stated carbon chain lengths and the degrees of alkoxylation and/or the degrees of ethoxylation of the aforementioned nonionic surfactants are statistical averages, which may be an integer or a fraction for a specific product. Based on the manufacturing process, commercial products of the aforementioned formulas usually do not consist of an individual representative but instead consist of mixtures, so that averages are obtained for the carbon chain lengths as well as for the degrees of ethoxylation and/or the degrees of alkoxylation, and fractional numbers are obtained from the averages.

Said nonionic surfactants may be used not only as individual substances but also as surfactant mixtures of two, three, four or more surfactants. Surfactant mixtures here refer not to mixtures of nonionic surfactants which as a whole fall under one of the general formulas given above, but instead refer to mixtures containing two, three, four or more nonionic surfactants which can be described by different ones of the general formulas given above.

Preferred automatic dishwashing agents according to the invention contain one or more builders as an additional essential component. The builders include in particular phosphates, silicates, carbonates and organic cobuilders.

Organic cobuilders that can be mentioned include in particular polycarboxylates/polycarboxylic acids, polymeric carboxylates, aspartic acid, polyacetals, dextrins and additional organic cobuilders. These classes of substances are described below.

Usable organic builder substances are, for example, the polycarboxylic acids usable in the form of the free acids and/or the sodium salts. For example, these include citric acid, adipic acid, succinic acid, glutaric acid, malic acid, tartaric acid, maleic acid, fumaric acid, sugar acids, aminocarboxylic acids as well as mixtures thereof. In addition to their builder effect, the free acids typically also have the property of an acidifying component and thus also serve to adjust a lower and milder pH of washing or cleaning agents. In particular these include citric acid, succinic acid, glutaric acid, adipic acid, gluconic acid and any mixtures thereof.

One embodiment of preferred inventive automatic dishwashing agents contains citrate as one of its essential builders. Inventive automatic dishwashing agents containing 5 to 60 wt %, preferably 10 to 50 wt % and especially 15 to 45 wt % citrate are preferred according to the invention.

Inventive automatic dishwashing agents preferably contain as the builder crystalline layered silicates of the general formula $NaMSi_x O_{2x+1}.yH_2O$ in which M denotes sodium or hydrogen, x is a number from 1.9 to 22, preferably from 1.9 to 4, whereby especially preferred values for x are 2, 3 or 4 and y stands for a number from 0 to 33 preferably from 0 to 20. Amorphous sodium silicates with an $Na_2O:SiO_2$ modulus of 1:2 to 1:3.3, preferably of 1:2 to 1:2.8 and especially 1:2 to 1:2.6, preferably having delayed dissolving properties and secondary washing properties may also be used.

Preferred automatic dishwashing agents within the scope of the present invention contain 2 to 15 wt %, preferably 3 to 12 wt % and especially 4 to 8 wt % silicate(s).

The use of carbonate(s) and/or bicarbonate(s), preferably alkali carbonate(s), especially preferably sodium carbonate, in amounts of 5 to 50 wt %, preferably 10 to 40 wt % and especially 10 to 30 wt %, each based on the weight of the automatic dishwashing agent, is especially preferred.

If this is unobjectionable for ecological reasons, the known alkali phosphates, in particular trisodium polyphosphate, may also be used as builders. Alkali phosphate is the general term for the alkali metal salts (in particular sodium and potassium salts) of the various phosphoric acids, where a distinction may be made between metaphosphoric acids $(HPO_3)_n$ and orthophosphoric acid $H_3PO_4$ plus higher-molecular weight representatives. The phosphates combine several advantages: they act as alkali carriers, prevent lime deposits on machine parts and/or lime encrustations on fabrics and also contribute toward the cleaning effect. Sodium dihydrogen phosphate $NaH_2PO_4$ exists as the dihydrate (density 1.91 $gcm^{-3}$, melting point 60° C.) and as the monohydrate (density 2.04 $gcm^{-3}$). Both salts are white powders that dissolve very easily in water, lose their water of crystallization when heated and form the weakly acidic diphosphate (disodium hydrogen diphosphate $Na_2H_2P_2O_7$) at 200° C., forming sodium trimetaphosphate ($Na_3P_3O_9$) and Madrell's salt at higher temperatures. $NaH_2PO_4$ gives an acid reaction; it is formed when phosphoric acid is adjusted to a pH of 4.5 with sodium hydroxide solution and the slurry is sprayed. Potassium dihydrogen phosphate (primary or monobasic potassium phosphate, potassium biphosphate KDP), $KH_2PO_4$ is a white salt with the density 2.33 $gcm^{-3}$, having a melting point of 253° C. (decomp. with the formation of $(KPO_3)_x$, potassium polyphosphate) and is readily soluble in water. Disodium hydrogen phosphate (secondary sodium phosphate) $Na_2HPO_4$ is a colorless very readily water-soluble crystalline salt which exists in an anhydrous form and with 2 mol of water (density 2.066 $gcm^{-3}$, water loss at 95° C.), 7 mol (density 1.68 $gcm^3$, melting point 48° C. with the loss of $5H_2O$) and 12 mol water (density 1.52 $gcm^3$, melting point 35° C. with a loss of $5H_2O$), become anhydrous at 100° C. and forms the diphosphate $Na_4P_2O_7$ when heated to a greater extent. Disodium hydrogen phosphate is synthesized by neutralizing phosphoric acid with soda solution using phenolphthalein as an indicator. Dipotassium hydrogen phosphate (secondary or dibasic potassium phosphate), $K_2HPO_4$ is an amorphous white salt which is readily soluble in water. Trisodium phosphate, tertiary sodium phosphate $Na_3PO_4$ forms colorless crystals which as the dodecahydrate have a density of 1.62 $gcm^{-3}$ and a melting point of 73-76° C. (decomp.), as the decahydrate (corresponding to 19-20% $P_2O_5$) have a melting point of 100° C. and in anhydrous form (corresponding to 39-40% $P_2O_5$) have a density of 2.536 $gcm^{-3}$. Trisodium phosphate is readily soluble in water with an alkaline reaction and is prepared by evaporating a solution of exactly 1 mol disodium phosphate and 1 mol NaOH. Tripotassium phosphate (tertiary or tribasic potassium phosphate), $K_3PO_4$, is a white deliquescing granular powder with a density of 2.56 $gcm^{-3}$, has a melting point of 1340° C. and is readily soluble in water with an alkaline reaction. It is formed, for example, when Thomas slag is heated with coal and potassium sulfate. Despite the higher price, the more readily soluble and therefore highly effective potassium phosphates are often preferred in the cleaning agent industry in comparison with the corresponding sodium compounds. Tetrasodium diphosphate (sodium pyrophosphate), $Na_4P_2O_7$ exists in an anhydrous form (density 2.534 $gcm^3$, melting point 988° C. also given as 880° C.) and as the decahydrate (density 1.815-1.836 $gcm^3$, melting point 94° C. with the loss of water). Both substances are colorless crystals which dissolve in water with an alkaline reaction. $Na_4P_2O_7$ is formed on heating disodium phosphate to >200° C. or by reacting phosphoric acid with soda in a stoichiometric ratio and dehydrating the solution by spraying. The decahydrate can chelate heavy metal salts and the salts responsible for hard water and therefore reduces the hardness of water. Potassium diphosphate (potassium pyrophosphate), $K_4P_2O_7$ exists in the form of the trihydrate and is a colorless hygroscopic powder with the density 2.33 $gcm^{-3}$, which is soluble in water; the pH of the 1% solution at 25° C. is 10.4. By condensation of $NaH_2PO_4$ and/or $KH_2PO_4$, higher-molecular sodium and potassium phosphates are formed, a distinction being made between cyclic compounds, the sodium and/or potassium metaphosphates, and chain compounds, the sodium and/or potassium polyphosphates. A variety of terms are in use for the later in particular: melt phosphates or calcined phosphates, Graham's salt, Kurrol's salt and Madrell's salt. All higher sodium and potassium phosphates are referred to jointly as condensed phosphates. Pentasodium triphosphate $Na_5P_3O_{10}$ (sodium tripolyphosphate) which is important industrially is a white, nonhygroscopic water-soluble salt that is anhydrous or crystallizes with $6H_2O$ and has the general formula NaO—[P(O)(ONa)—O]$_n$—Na, where n=3. At room temperature approx. 17 g of the anhydrous salt will dissolve in 100 g water, at 60° C. approx 20 g will dissolve and at 100° C. approx. 32 g; after heating the solution for 2 hours at 100° C., approx. 8% orthophosphate and 15% diphosphate are formed by hydrolysis. In the synthesis of pentasodium triphosphate, phosphoric acid is reacted with soda solution or sodium hydroxide solution in a stoichiometric ratio and the solution is dehydrated by spraying. Like Graham's salt and sodium diphosphate, pentasodium triphosphate will dissolve many insoluble metal compounds (including lime soaps, etc.). Pentapotassium triphosphate $K_5P_3O_{10}$ (potassium tripolyphosphate) is marketed in the form of a 50 wt % solution (>23% $P_2O_5$, 25% $K_2O$), for example. The potassium polyphosphates are used widely in the washing and cleaning agent industry. In addition, there are also sodium-potassium tripolyphosphates which may also be used within the scope of the present invention. These are formed, for example, when sodium trimetaphosphate is hydrolyzed with KOH:

$$(NaPO_3)_3+2KOH \rightarrow Na_3K_2P_3O_{10}+H_2O.$$

These may be used just like sodium tripolyphosphate, potassium tripolyphosphate or mixtures of these two. Mixtures of sodium tripolyphosphate and sodium-potassium tripolyphosphate or mixtures of potassium tripolyphosphate and sodium-potassium tripolyphosphate or mixtures of sodium tripolyphosphate and potassium tripolyphosphate and sodium-potassium tripolyphosphate may also be used.

An inventive agent in a preferred embodiment contains up to 60 wt %, in particular 35 wt % to 50 wt % phosphate. In other preferred embodiments, it contains 5 wt % to 60 wt %, preferably 10 wt % to 50 wt %, and in particular 15 wt % to 45 wt % citrate and is phosphate-free or contains 15 wt % to 25 wt % phosphate.

In addition, polymeric polycarboxylates are also suitable as builders. These are, for example, the alkali metal salts of polyacrylic acid or polymethacrylic acid, e.g., those with a relative molecular weight of 500 to 70,000 g/mol. Suitable polymers include, for example, polyacrylates, which preferably have a molecular weight of 2000 to 20,000 g/mol. Because of their superior solubility, the short-chain polyacrylates having molecular weights of 2000 to 10,000 g/mol and especially preferably 3000 to 5000 g/mol may be preferred from this group.

Furthermore, copolymeric polycarboxylates are suitable, in particular those of acrylic acid with methacrylic acid and of acrylic acid or methacrylic acid with maleic acid. Copolymers of acrylic acid with maleic acid containing 50 wt % to 90 wt % acrylic acid and 50 wt % to 10 wt % maleic acid have proven to be especially suitable. Their relative molecular weight, based on free acids, is generally 2000 g/mol to 70,000 g/mol, preferably 20,000 g/mol to 50,000 g/mol and especially 30,000 to 40,000 g/mol. The (co)polymeric polycarboxylates may be used either as a powder or as an aqueous solution. The (co)polymeric polycarboxylate content of automatic dishwashing agents is preferably 0.5 to 20 wt % and especially 3 to 10 wt %.

Preferred inventive automatic dishwashing agents also contain one or more bleaching agents. Of the compounds which supply $H_2O_2$ in water and serve as bleaching agents, sodium percarbonate, sodium perborate tetrahydrate and sodium perborate monohydrate have become especially important. Other usable bleaching agents include, for example, peroxypyrophosphates, citrate perhydrates and peracid salts which supply $H_2O_2$ or peracids such as perbenzoates, peroxophthalates, diperazelaic acid, phthaloimino peracid or diperdodecanedioic acid.

In addition, bleaching agents from the group of organic bleaching agents may also be used. The diacyl peroxides, e.g., dibenzoyl peroxide, are typical organic bleaching agents. Other typical organic bleaching agents are the peroxy acids, where the alkylperoxy acids and arylperoxy acids may be mentioned in particular as examples.

Automatic dishwashing agents containing 1 to 20 wt %, preferably 2 to 15 wt % and in particular 4 to 12 wt % sodium percarbonate are preferred according to the invention.

If desired, substances that release chlorine or bromine may also be used as bleaching agents. Of the suitable materials releasing chlorine or bromine, for example, heterocyclic N-bromoamides and N-chloroamides may be considered, e.g., trichloroisocyanuric acid, tribromoisocyanuric acid, dibromoisocyanuric acid and/or dichloroisocyanuric acid (DICA) and/or their salts with cations such as potassium and sodium. Hydantoin compounds, e.g. 1,3-dichloro-5,5-dimethylhydantoin are also suitable.

To achieve an improved bleaching effect when cleaning at temperatures of 60° C. or lower, the inventive automatic dishwashing agents may additionally contain bleach activators. Bleach activators that may be used include compounds which yield aliphatic peroxocarboxylic acids preferably with 1 to 10 carbon atoms, especially 2 to 4 carbon atoms and/or optionally substituted perbenzoic acid under perhydrolysis conditions. Substances which have O— and/or N-acyl groups of the aforementioned carbon number and/or optionally substituted benzoyl groups are also suitable. Polyacylated alkylenediamines are preferred, and tetraacetylethylenediamine (TAED) has proven especially suitable.

Bleach activators, in particular TAED, are preferably used in amounts up to 10 wt %, in particular 0.1 wt % to 8 wt %, especially 2 to 8 wt % and especially preferably 2 to 6 wt %, each based on the total weight of the agent containing the bleach activator.

In addition to or instead of such conventional bleach activators, so-called bleach catalysts may also be used. These substances are bleach-potentiating transition metal salts and/or transition metal chelates, e.g., Mn—, Fe—, Co—, Ru— or Mo-salene chelates or carbonyl chelates. Mn, Fe, Co, Ru, Mo, Ti, V and Cu chelates with tripod ligands containing nitrogen as well as Co—, Fe—, Cu— and Ru-ammine chelates may also be used as bleach catalysts.

Chelates of manganese in the oxidation stage II, III or IV, preferably having one or more macrocyclic ligands with the donor functions N, NR, PR, O and/or S are especially preferred. Ligands having nitrogen donor functions are preferably used. It is especially preferable to use bleach catalyst(s) containing 1,4,7-trimethyl-1,4,7-triazacyclononane (Me-TACN), 1,4,7-triazacyclononane (TACN), 1,5,9-trimethyl-1,5,9-triazacyclododecane (Me-TACD), 2-methyl-1,4,7-trimethyl-1,4,7-triazacyclononane (Me/Me-TACN) and/or 2-methyl-1,4,7-triazacyclononane (Me/TACN) as the macromolecular ligands in the inventive agents. Suitable manganese chelates include, for example, $[Mn^{III}_2(\mu\text{-}O)_1(\mu\text{-}OAc)_2(TACN)_2](ClO_4)_2$,
$[Mn^{III}Mn^{IV}(\mu\text{-}O)_2(\mu\text{-}OAc)_1(TACN)_2](BPh_4)_2$,
$[Mn^{IV}_4(\mu\text{-}O)_6(TACN)_4](ClO_4)_4$,
$[Mn^{III}_2(\mu\text{-}O)_1(\mu\text{-}OAc)_2(Me\text{-}TACN)_2](ClOC_4)_2$,
$[Mn^{III}Mn^{IV}(\mu\text{-}O)_1(\mu\text{-}OAc)_2(Me\text{-}TACN)_2](ClO_4)_4$,
$[Mn^{III}_2(\mu\text{-}O)_1(\mu\text{-}OAc)_2(Me\text{-}TACN)_2](ClO_4)_2$,
$[Mn^{III}Mn^{IV}(\mu\text{-}O)_1(\mu\text{-}OAc)_2(Me\text{-}TACN)_2](ClO_4)_3$,
$[Mn^{IV}_2(\mu\text{-}O)_3(Me\text{-}TACN)_2](PF_6)_2$ and $[Mn^{IV}_2(\mu\text{-}O)_3(M3/Me\text{-}TACN)_2](PF_6)_2$ ($OAc=OC(O)CH_3$).

Automatic dishwashing agents containing a bleach catalyst selected from the group of bleach-potentiating transition metal salts and transition metal chelates, preferably from the group of chelates of manganese with 1,4,7-trimethyl-1,4,7-triazacyclononane ($Me_3$-TACN) or 1,2,4,7-tetramethyl-1,4,7-triazacyclononane ($Me_4$-TACN) are preferred according to the invention because the cleaning result in particular can be improved significantly through the aforementioned bleach catalysts.

The aforementioned bleach-potentiating transition metal chelates, in particular with the central atoms Mn and Co are used in conventional amounts, preferably in an amount up to 5 wt %, in particular 0.0025 wt % to 1 wt % and especially preferably from 0.01 wt % to 0.30 wt %, each based on the total weight of the agents. However, more bleach catalyst may also be used in special cases.

Preferred inventive automatic dishwashing agents additionally contain a chelating agent, preferably a phosphonic acid and/or a phosphonate and/or an aminocarboxylic acid, of these preferably methylglycine diacetic acid (MGDA) and/or nitrilotriacetic acid (NTA) unless there are ecological objections to their use.

The chelating phosphonates comprise, in addition to 1-hydroxyethane-1,1-diphosphonic acid, a number of different compounds such as diethylenetriaminepenta(methylenephosphonic acid) (DTPMP). In particular, hydroxylalkanephosphonates and/or aminoalkanephosphonates are preferred. Of the hydroxyalkanephosphonates, 1-hydroxyethane-1,1-diphosphonate (HEDP) is especially important as a cobuilder. It is preferably used as a sodium salt; the disodium salt gives a neutral reaction and the tetrasodium salt gives an alkaline reaction (pH 9). Ethylenediaminetetramethylenephosphonate (EDTMP), diethylenetriaminepentamethylenephosphonate (DTPMP) and their higher homologs may be considered as the aminoalkanephosphonates. They are preferably used in the form of the neutral sodium salts, e.g. as the hexasodium salt of EDTMP and/or as the hepta- and octasodium salts of DTPMP. From the class of phosphonates, HEDP is preferably used as a builder. The aminoalkanephosphonates also have a pronounced heavy metal binding capacity. Accordingly, especially when the agents also contain bleach, it may be preferable to use aminoalkanephosphonates, in particular DTPMP or mixtures of said phosphonates.

A preferred automatic dishwashing agent contains one or more phosphonates from the group:

a) aminotrimethylenephosphonic acid (ATMP) and/or salts thereof;

b) ethylenediaminetetra(methylenephosphonic acid) (EDTMP) and/or salts thereof;

c) diethylenetriaminepenta(methylenephosphonic acid) (DTPMP) and/or salts thereof;

d) 1-hydroxyethane-1,1-diphosphonic acid (HEDP) and/or salts thereof;

e) 2-phosphonobutane-1,2,4-tricarboxylic acid (PBTC) and/or salts thereof;

f) hexamethylenediaminetetra(methylenephosphonic acid) (HDTMP) and/or salts thereof;

g) nitrilotri(methylenephosphonic acid) (NTMP) and/or salts thereof.

Automatic dishwashing agents containing 1-hydroxyethane-1,1-diphosphonic acid (HEDP) or diethylenetriaminepenta(methylenephosphonic acid) (DTPMP) are especially preferred.

Inventive automatic dishwashing agents may, if desired, also contain two or more different phosphonates and/or aminocarboxylic acids. Especially preferred automatic dishwashing agents are those containing as the phosphonates both 1-hydroxyethane-1,1-diphosphonic acid (HEDP) and diethylenetriaminepenta(methylenephosphonic acid) (DTPMP), where the weight ratio of HEDP to DTPMP is between 20:1 and 1:20, preferably between 15:1 and 1:15, and in particular between 10:1 and 1:10.

The amount by weight of these chelating agents, in particular the sum of the amount by weight of 1-hydroxyethane-1,1-diphosphonic acid (HEDP) and methylglycine diacetic acid (MGDA) is preferably 0.5 to 14 wt %, especially 1 to 12 wt % and in particular 2 to 8 wt %. In an especially preferred embodiment, an inventive agent contains up to 5 wt %, in particular 0.5 wt % to 2 wt % phosphonate.

In addition to these ingredients, preferred automatic dishwashing agents contain additional ingredients, preferably active ingredients from the group of polymer, enzymes, corrosion inhibitors and scents and/or dyes.

The group of washing or cleaning active polymer include, for example, the polymers that act as water softeners and clear rinse polymers which may be used, if desired, in addition to the active ingredient used according to the invention. In general, cationic, anionic and amphoteric polymers can also be used in addition to nonionic polymers in washing and cleaning agents.

The additional clear rinse polymer which is optionally present is preferably a copolymer, comprising monomers of at least two of the following groups of i) monomers from the group of mono- or polyunsaturated carboxylic acids of the general formula:

$R^8(R^9)C{=}C(R^{10})COOH$, in which $R^8$ to $R^{10}$, independently of one another, stand for —H, —$CH_3$, a linear or branched, saturated alkyl radical with 2 to 12 carbon atoms, a linear or branched, mono- or polyunsaturated alkenyl radical with 2 to 12 carbon atoms, alkyl or alkenyl radicals, as defined above, substituted with —$NH_2$, —OH or —COOH, or they stand for —COOH or —$COOR^4$, where $R^4$ is a saturated or unsaturated, linear or branched hydrocarbon radical with 1 to 12 carbon atoms;

ii) monomers of the general formula:

$R^{11}(R^{12})C{=}C(R^{13})$—X—$R^{14}$ in which $R^{11}$ to $R^{13}$, independently of one another, stand for —H, —$CH_3$ or —$C_2H_5$, X stands for an optional spacer group, selected from —$CH_2$—, —C(O)O— and —C(O)—NH—, and $R^{14}$ stands for a linear or branched, saturated alkyl radical with 2 to 22 carbon atoms or an unsaturated radical, preferably aromatic, with 6 to 22 carbon atoms;

iii) monomers containing sulfonic acid groups and having the general formula $R^{15}(R^{16})C{=}C(R^{17})$—X'—$SO_3H$, in which $R^{15}$ to $R^{17}$, independently of one another, stand for —H, —$CH_3$, a linear or branched, saturated alkyl radical with 2 to 12 carbon atoms, a linear or branched, mono- or polyunsaturated alkenyl radical with 2 to 12 carbon atoms, alkyl or alkenyl radicals substituted with —$NH_2$, —OH or —COOH, or they stand for COOH or $COOR^1$, where $R^{13}$ is a saturated or unsaturated, linear or branched hydrocarbon radical with 1 to 12 carbon atoms, and X' stands for an optional spacer group, which is selected from —$(CH_2)_n$—, where n=0 to 4, —COO—$(CH_2)_k$—, where k=1 to 6, —C(O)—NH—$C(CH_3)_2$— and —C(O)—NH—CH$(CH_2CH_3)$—;

iv) other ionic and/or nonionic monomers.

In the polymers, the carboxylic acid groups and/or sulfonic acid groups may be present entirely or partially in neutralized form, i.e., the acidic hydrogen atom of the acid group may be exchanged for metal ions in some or all acid groups, preferably for alkali metal ions and in particular for sodium ions. The use of partially or fully neutralized copolymers containing sulfonic acid groups is preferred according to the invention.

"Cationic polymers" in the sense of the present invention are polymers which have a positive charge in the polymer molecule. These can be implemented, for example, through (alkyl)ammonium groups present in the polymer chain or other positively charged groups. Especially preferred cationic polymers come from the groups of quaternated cellulose derivatives, polysiloxanes with quaternary groups, cationic guar derivatives, polymeric dimethyldiallylammonium salts and their copolymers with esters and amides of acrylic acid and methacrylic acid, copolymers of vinylpyrrolidone with quaternated derivatives of dialkylaminoacrylate and methacrylate, vinylpyrrolidone-methoimidazolinium chloride copolymers, quaternated polyvinyl alcohols or polymers denoted by the INCI designations polyquaternium 2, polyquaternium 17, polyquaternium 18 and polyquaternium 27.

"Amphoteric polymers" in the sense of the present invention not only have cationic groups but also have anionic groups and/or monomer units. For example, such anionic monomer units come from the group of linear or branched, saturated or unsaturated carboxylates, linear or branched, saturated or unsaturated phosphonates, linear or branched, saturated or unsaturated sulfates or linear or branched, saturated or unsaturated sulfonates, Preferred monomer units include acrylic acid, (meth)acrylic acid, (dimethyl)acrylic acid, (ethyl)acrylic acid, cyanoacrylic acid, vinyl acetic acid, allyl acetic acid, crotonic acid, maleic acid, fumaric acid, cinnamic acid and their derivatives, allylsulfonic aids, e.g. allyloxybenzenesulfonic acid and methallylsulfonic acid or the allylphosphonic acids. Amphoteric polymers preferred for use here come from the group of alkylacrylamide/acrylic acid copolymers, alkylacrylamide/methacrylic acid copolymers, alkylacrylamide/methyl methacrylic acid copolymers, alkylacrylamide/acrylic acid/alkylaminoalkyl (meth)acrylic acid copolymers, alkylacrylamide/methacrylic acid/alkylaminoalkyl (meth)acrylic acid copolymer, alkylacrylamide/alkyl methacrylate—alkylaminoethyl methacrylate/alkyl methacrylate copolymers as well as the copolymers of unsaturated carboxylic acids, cationically derivatized unsaturated carboxylic acids and optionally other ionic or nonionic monomers.

Zwitterionic polymers preferred for use here come from the group of acrylamidoalkyl trialkylammonium chloride/acrylic acid copolymers as well as their alkali and ammonium salts, acrylamidoalkyltrialkylammonium chloride/methacrylic acid copolymers and their alkali and ammonium salts as well as methacroylethylbetaine/methacrylate copolymers.

Within the scope of the present invention, especially preferred cationic or amphoteric polymers contain as the monomer unit a compound of the general formula:

$$H_2C{=}(CR^{19}){-}(CH_2)_x{-}(N^+R^{20}R^{21}){-}(CH_2)_y{-}(CR^{22}){=}CH_2G^-,$$

in which $R^{19}$ and $R^{22}$, independently of one another, stand for H or a linear or branched hydrocarbon radical with 1 to 6 carbon atoms; $R^{20}$ and $R^{21}$, independently of one another, stand for an alkyl, hydroxylalkyl or aminoalkyl group, in which the alkyl radical is linear or branched and has between 1 and 6 carbon atoms, but it is preferably a methyl group; x and y, independently of one another, stand for integers between 1 and 3; $G^-$ represents a counterion, preferably a counterion from the group of chloride, bromide, iodide, sulfate, hydrogen sulfate, methosulfate, lauryl sulfate, dodecylbenzenesulfonate, p-toluenesulfonate (tosylate), cumenesulfonate, xylenesulfonate, phosphate, citrate, formate, acetate or mixtures thereof.

Preferred radicals $R^{19}$ and $R^{22}$ in the above formula are selected from $-CH_3$, $-CH_2-CH_3$, $-CH_2-CH_2-CH_3$, $-CH(CH_3)-CH_3$, $-CH_2-OH$, $-CH_2-CH_2-OH$, $-CH(OH)-CH_3$, $-CH_2-CH_2-CH_2-OH$, $-CH_2-CH(OH)-CH_3$, $-CH(OH)-CH_2-CH_3$ and $-(CH_2-CH_2-O)_nH$. Most especially preferred are polymers having a cationic monomer unit of the general formula given above, in which $R^{19}$ and $R^{22}$ stand for H, $R^{20}$ and $R^{21}$ stand for methyl, and x and y each are 1.

Cleaning agents preferably contain the preferred cationic and/or amphoteric polymers in amounts up to 10 wt %, especially between 0.01 and 10 wt %, each based on the total weight of the agent. Within the scope of the present patent application, such cleaning agents in which the amount by weight of the cationic and/or amphoteric polymers is between 0.01 and 8 wt %, preferably between 0.01 and 6 wt %, especially between 0.01 and 4 wt %, especially preferably between 0.01 and 2 wt % and in particular between 0.01 and 1 wt %, each based on the total weight of the automatic dishwashing agent, are preferred.

To increase the washing and/or cleaning performance of washing or cleaning agents, enzymes may be used. These include in particular proteases, amylases, lipases, hemicellulases, cellulases, perhydrolases or oxido-reductases as well as preferably mixtures thereof. These enzymes are in principle of natural origin; starting from the natural molecules, improved variants which are preferably used accordingly are available for use in washing and cleaning agents. Washing or cleaning agents preferably contain enzymes in total amounts of $1\times10^{-6}$ to 5 wt %, based on active protein. The protein concentration can be determined with the help of known methods, e.g., the BCA method or the biuret method.

Of the proteases, those of the subtilisin type are preferred. Examples include subtilisins BPN' and Carlsberg as well as their more advanced forms, protease PB92, subtilisins 147 and 309, the alkaline protease from *Bacillus lentus*, subtilisin DY and the enzymes thermitase, proteinase K and proteases TW3 and TW7, which are classified as subtilases but are no longer classified as subtilisins in the narrower sense.

Examples of the amylases that may be used according to the invention include the α-amylases from *Bacillus licheniformis*, from *B. amyloliquefaciens*, from *B. stearothermophilus*, from *Aspergillus niger* and *A. oryzae* as well as the improved further developments of the aforementioned amylases for use in washing and cleaning agents. In addition, the α-amylase from *Bacillus* sp. A 7-7 (DSM 12368) and the cyclodextrin glucanotransferase (CGTase) from *B. agaradherens* (DSM 9948) are to be emphasized for this purpose.

In addition, lipases or cutinases may be used according to the invention, in particular because of their triglyceride-cleaving activities, but also to create peracids in situ from suitable precursors. These include, for example, the lipases originally obtainable from *Humicola lanuginosa* (*Thermomyces lanuginosus*) and/or further developed lipases, in particular those with the amino acid exchange D96L. Furthermore, the cutinases originally isolated *Fusarium solani pisi* and *Humicola insolens* may also be used. In addition, lipases and/or cutinases whose starting enzymes were originally isolated from *Pseudomonas mendocina* and *Fusarium solanii* may also be used.

Furthermore, enzymes combined under the term hemicellulases may also be used. These include, for example, mannanases, xanthan lyases, pectin lyases (=pectinases), pectinesterases, pectate lyases, xyloglucanases (=xylanases), pullulanases and β-glucanases.

To increase the bleaching effect, oxidoreductases, e.g. oxidases, oxygenases, catalases, peroxidases such as halo-, chloro-, bromo-, lignin-, glucose or manganese peroxidases, dioxygenases or laccases (phenol oxidases, polyphenol oxidases) may be used according to the invention. In addition, preferably organic, especially preferably aromatic compounds that interact with the enzymes are advantageously also added to potentiate the activity of the respective oxidoreductases (enhancers) or to ensure the flow of electrons between the oxidizing enzymes and the soiling when there is a great difference in redox potentials (mediators).

The enzymes may be used in any form established according to the prior art. This includes, for example, the solid preparations obtained by granulation, extrusion or lyophilization or, especially in the case of liquid or gelatinous agents, solutions of the enzymes, advantageously in the highest possible concentration, with a low water content and/or mixed with stabilizers.

Alternatively, the enzymes for both the solid and liquid dosage forms may be encapsulated, e.g., by spray drying or extrusion of the enzyme solution together with a polymer, preferably natural, or in the form of capsules, e.g., those in which the enzymes are enclosed as in a solidified gel or in those of the core-shell type, in which an enzyme-containing core is coated with a protective layer impermeable to water, air and/or chemicals. In addition, other active ingredients, e.g. stabilizers, emulsifiers, pigments, bleachers or dyes may also be applied in supported layers. Such capsules are applied by known methods, e.g. by shaking granulation or rolling granulation or in fluidized-bed processes. Such granules are advantageously low-dust materials due to the application of polymeric film-forming substances and are stable in storage due to the coating.

It is also possible to fabricate two or more enzymes together, so that one granular product contains multiple enzyme activities.

A protein and/or enzyme can be protected from damage during storage, e.g., inactivation, denaturing or decomposition due to physical influences, oxidation or proteolytic cleavage. When the proteins and/or enzymes are produced microbially, inhibition of proteolysis is especially preferred, in particular when the agents also contain proteases. Washing or cleaning agents may contain stabilizers for this purpose; providing such agents constitutes a preferred embodiment of the present invention.

One or more enzymes and/or enzyme preparations, preferably solid protease preparations and/or amylase preparations are preferred for use in amounts of 0.1 to 5 wt %, preferably 0.2 to 5 wt % and especially 0.4 to 5 wt %, each based on the total enzyme-containing agent.

In summary, inventive automatic dishwashing agents, comprising, in addition to the inventive active ingredient, the following are preferred:

a) 35 to 50 wt % phosphate or 15 to 45 wt % citrate,
b) 2 to 8 wt % nonionic surfactant(s),
c) 4 to 16 wt % polymer(s),
d) 2 to 15 wt % sodium percarbonate,
e) 1 to 6 wt % enzyme.

Glass corrosion inhibitors prevent the development of cloudiness, streaks and scratches but also prevent irising of the glass surface of machine-cleaned glasses. Preferred glass corrosion inhibitors come from the group of magnesium and zinc salts as well as magnesium and zinc chelates. The spectrum of zinc salts preferred according to the invention, preferably organic acids, especially preferably organic carboxylic acids, ranges from salts having little or no water solubility, i.e., a solubility of less than 100 mg/L, preferably less than 10 mg/L, especially less than 0.01 mg/L, to salts having a water solubility greater than 100 mg/L, preferably greater than 500 mg/L, especially preferably greater than 1 g/L and in particular greater than 5 g/L (all solubilities at a water temperature of 20° C.). The first group of zinc salts includes, for example, zinc citrate, zinc oleate and zinc stearate; the group of soluble zinc salts includes, for example, zinc formate, zinc acetate, zinc lactate and zinc gluconate.

Especially preferably at least one zinc salt of an organic carboxylic acid, especially preferably a zinc salt from the group of zinc stearate, zinc oleate, zinc gluconate, zinc acetate, zinc lactate and zinc citrate is used as the glass corrosion inhibitor. Zinc ricinoleate, zinc abietate and zinc oxalate are also preferred.

Within the scope of the present invention, the zinc salt content in washing or cleaning agents preferably amounts to between 0.1 and 5 wt %, preferably between 0.2 and 4 wt % and especially between 0.4 and 3 wt %, and/or the zinc content in oxidized form (calculated as $Zn^{2+}$) is between 0.01 wt % and 1 wt %, preferably between 0.02 wt % and 0.5 wt %, and especially between 0.04 wt % and 0.5 wt %, each based on the total weight of the glass corrosion inhibitor-containing agent.

Corrosion inhibitors serve to protect the washed dishes or the machine, silver protectants being especially important in the area of automatic dishwashing. The known state-of-the-art substances may be used. In general, mainly silver protectants selected from the group of triazoles and transition metal salts or chelates may be used. Especially preferred for use here are benzotriazole and/or alkylaminotriazole. According to the invention, 3-amino-5-alkyl-1,2,4-triazoles and/or their physiologically tolerable salts are preferred, where these substances are especially preferably used in a concentration of 0.001 to 10 wt %, preferably 0.0025 to 2 wt %, especially preferably 0.01 to 0.04 wt %.

To facilitate the disintegration of prefabricated molded articles, it is possible to incorporate disintegration aids, so-called tablet disintegrants into these agents to shorten the disintegration times.

These substances, also known as "disintegrants" based on their action, increase their volume when water is added, whereupon first the intrinsic volume increases (swelling) on the one hand, while on the other hand a pressure can be created via the release of gases, causing the tablet to disintegrate into smaller particles. Old familiar disintegration aids include, for example, carbonate/citric acid systems, but other organic acids may also be used. Swelling disintegration aids include, for example, synthetic polymers such as polyvinylpyrrolidone (PVP) or natural polymers and/or modified natural substances such as cellulose and starch and their derivatives, alginates or casein derivatives.

Disintegration aids in amounts of 0.5 to 10 wt %, preferably 1 to 7 wt % and especially 1 to 5 wt %, each based on the total weight of the agent containing the disintegration aid are preferably used.

Disintegrants based on cellulose are used as preferred disintegrants, so that preferred washing or cleaning agents contain such a disintegrant in amounts of 0.5 to 10 wt %, preferably 1 to 7 wt % and especially 1 to 5 wt %, based on cellulose. The cellulose used as a disintegration aid is preferably not used in finely divided form but instead is converted to a coarser form, e.g., granulated or compacted, before being added to the premixes to be pressed. The particle sizes of such disintegrants are usually greater than 200 μm, preferably at least 90 wt % of the particles being between 300 μm and 1600 μm and especially at least 90 wt % being between 400 μm and 1200 μm.

Preferred disintegration aids, preferably a disintegration aid based on cellulose, preferably in granular, cogranular or compacted form, are present in the agents containing the disintegrant in amounts of 0.5 to 10 wt %, preferably 1 wt % to 7 wt % and especially 1 to 5 wt %, each based on the total weight of the agent containing the disintegrant.

In addition, gas-evolving effervescent systems may preferably also be used as tablet disintegration aids according to invention. The gas-evolving effervescent system may consist of a single substance, which releases a gas on coming in contact with water. Of these compounds, magnesium peroxide should be mentioned in particular, because it releases oxygen on contact with water. However, preferred effervescent systems consist of at least two components, which react to form a gas, e.g., an alkali metal carbonate and/or bicarbonate and an acidifying agent suitable for releasing carbon dioxide from the alkali metal salts in aqueous solution. Examples of acidifying agents that release carbon dioxide from the alkali salts in aqueous solution include boric acid and alkali metal hydrogen sulfates, alkali metal dihydrogen phosphates and other inorganic salts. However, organic acidifying agents are preferred for use, citric acid being an especially preferred acidifying agent. Acidifying agents are preferably used in effervescent systems from the group of organic di-, tri- and oligocarboxylic acids and/or mixtures.

Individual fragrance compounds, e.g., the synthetic products of the type of esters, ethers, aldehydes, ketones, alcohols and hydrocarbons may be used as the perfume oils and/or scents within the scope of the present invention. However, mixtures of different perfumes which together create an attractive scent noted are preferred. Such perfume oils may also contain natural perfume mixtures such as those accessible from plant sources, e.g. pine, citrus, jasmine, patchouli, rose or ylang-ylang oil. The scents may be processed directly but it may also be advantageous to apply the scents to carriers which ensure a more gradual release of the scent for a long-lasting scent. Suitable carrier materials have proven to be cyclodextrins, for example, where the cyclodextrin-perfume chelates may also be coated with other additives.

Preferred dyes, selection of which does not pose any problems for those skilled in the art, have a high stability in storage and are insensitive to the other ingredients of the agents and insensitive to light as well as having no marked substantivity with respect to the substrates such as textiles, glass, ceramics or plastic dishes, to be treated with the agents containing the dye, so as not to stain them.

The inventive automatic dishwashing agents may also be finished in solid or liquid form but may also be in the form of a combination of solid and liquid forms.

In particular, powders, granules, extrudates or compactates, in particular tablets, are suitable as the solid forms of delivery. The liquid forms based on water and/or organic solvents may be thickened or in the form of gels.

Inventive agents may be finished as single-phase or multiphase products. In particular automatic dishwashing agents with one, two, three or four phases are preferred. Especially preferred automatic dishwashing agents are characterized in that they are in the form of a prefabricated dosing unit with two or more phases.

The individual phases of polyphase agents may be in the same or different physical states. In particular automatic dishwashing agents having at least two different solid phases and/or at least two liquid phases and/or at least one solid phase and at least one liquid phase are preferred.

Inventive automatic dishwashing agents are preferably prefabricated to dosing units. These dosing units preferably comprise the amount of active washing substances or active cleaning substances required for a cleaning operation. Preferred dosing units have a weight between 6 g and 30 g, preferably between 14 g and 26 g and in particular between 15 g and 22 g.

The volume of the aforementioned dosing units as well as their three-dimensional shape are especially preferably selected so that dosability of the prefabricated units through the dosing chamber of a dishwashing machine is ensured. The volume of the dosing unit is therefore preferably between 10 mL and 35 mL, especially between 5 mL and 30 mL and in particular between 15 and 20 mL.

The inventive automatic dishwashing agents, in particular the prefabricated dosing units, especially preferably have a water-soluble sheathing.

The subject of the present invention is also a method for cleaning dishes in a dishwashing machine using inventive automatic dishwashing agents, such that the automatic dishwashing agents are preferably dosed into the interior of a dishwashing machine while running through a dishwashing program, before the start of the main wash cycle or during the course of the main wash cycle. The dosing, i.e., addition of the inventive agent to the interior of the dishwashing machine may be performed manually, but the agent is preferably dosed into the interior of the dishwashing machine by means of the dosing chamber of the dishwashing machine. In the course of the cleaning operation, preferably no additional clear rinse and no additional water softener are dosed into the interior of the dishwashing machine.

As described in the beginning, the inventive agents in comparison with traditional automatic dishwashing agents are characterized by an improved clear rinse effect and an improved drying effect. The use of an inventive automatic dishwashing agent as a clear rinse agent in automatic dishwashing and the use of an inventive automatic dishwashing agent as a drying accelerator in automatic dishwashing are therefore additional subjects of the present patent application.

EXAMPLES

Dirty dishes are washed in a dishwashing machine using 21 g of a commercial phosphate-containing automatic dishwashing agent V1 and/or 21 g of the phosphate-free automatic dishwashing agent V2 and/or the same amount of the respective agents E1 to E4 having the inventive composition with a water hardness of 210° dH.

The composition (amounts given in weight percent) of the dishwashing agents used can be seen from the following table:

| Composition | V1 | E1 | E2 | V2 | E3 | E4 |
|---|---|---|---|---|---|---|
| Phosphate | 33 | 33 | 33 | — | — | — |
| Citrate | — | — | — | 23 | 23 | 23 |
| Phosphonate | 2.0 | 2.0 | 2.0 | 2.0 | 2.0 | 2.0 |
| Copolymer | 12.0 | 12.0 | 12.0 | 12.0 | 12.0 | 12.0 |
| Soda | 28.0 | 28.0 | 28.0 | 28.0 | 28.0 | 28.0 |
| Sodium percarbonate | 10.0 | 10.0 | 10.0 | 10.0 | 10.0 | 10.0 |
| TAED | 2.4 | 2.4 | 2.4 | 2.4 | 2.4 | 2.4 |
| Protease/amylase granules | 4.0 | 4.0 | 4.0 | 4.0 | 4.0 | 4.0 |
| Nonionic surfactant | 5.0 | 5.0 | 5.0 | 5.0 | 5.0 | 5.0 |
| Active ingredient I | — | 2.0 | — | — | 2.0 | — |
| Active ingredient II | — | — | 2.0 | — | — | 2.0 |
| Other | to 100 | to 100 | to 100 | to 100 | to 100 | to 100 |

The overall appearance of the washed dishes (consisting of plastic, glass, porcelain and stainless steel) was evaluated on the basis of the following evaluation scales:

For clear rinsing: 10=no drops formed to 0=heavy formation of drops

Evaluation scale for drying: 0=no drops to 6=more than five drops

It has been found that the inventive formulations E1 and E2 lead to a significant reduction in the formation of lime deposits and an improvement in drying of plastic dishes in particular in comparison with formulation V1, which does not contain the active ingredient according to the invention. The inventive formulations E3 and E4 led to a significant reduction in the formation of lime deposits and an improvement in drying of plastic dishes, in particular in comparison with formulation V2 without the inventive active ingredient.

The invention claimed is:

1. An automatic dishwashing agent, comprising:

a. 0.5 to 3 wt % at least one polycarbonate-, polyurethane- and/or polyurea-polyorganosiloxane compound, comprising at least one structural element of Formula (I):

$$—Y-A-(C{=}O)-A- \quad (I)$$

where each A is selected, independently, from S, O and $NR^1$,

Y is a divalent or polyvalent, linear, cyclic or branched, saturated, unsaturated or aromatic, substituted or unsubstituted hydrocarbon radical with up to 1000 carbon atoms (not counting the carbon atoms of a polyorganosiloxane unit that is optionally also present), which may contain one or more groups selected from —O—, —(CO)—, —NH—, —$NR^2$—, —($N^+R^2R^3$)— and a polyorganosiloxane unit with 2 to 1000 silicon atoms, $R^1$ is hydrogen or a linear, cyclic or branched, saturated, unsaturated or aromatic hydrocarbon radical with up to 40 carbon atoms, which may contain one or more groups selected from —O—, —(CO)—, —NH— and —$NR^2$—, $R^2$ is a linear, cyclic or branched, saturated, unsaturated or aromatic hydrocarbon radical with up to 40 carbon atoms, which may contain one or more groups selected from —O—, —(CO)— and —NH—, $R^3$ is a linear, cyclic or branched, saturated, unsaturated or aromatic hydrocarbon radical with up to 100 carbon atoms, which may contain one or more groups selected from —O—, —(CO)— and —NH— or is a divalent radical, which forms a cyclic structure within the radical Y, or one or both radicals A vicinal to Y together with the radical Y between them may form a heterocyclic radical containing nitrogen, and not all the radicals A and/or Y and/or $R^1$ and/or $R^2$ and/or $R^3$ indicated in formula (I) within the entire compound must be the same, with the provision that at least one of the radicals Y in the entire compound is a polyorganosiloxane unit with 2 to 1000 silicon atoms or an acid addition compound and/or salt thereof;

b. up to 60 wt % $_{phosphate\ or}$ 15 to 45 wt % citrate;

c. 2 to 8 wt % nonionic surfactant(s);

d. 4 to 16 wt % polymer(s);

e. 2 to 15 wt % sodium percarbonate; and f. 1 to 6 wt % enzyme(s).

2. The agent according to claim 1, wherein the polyorganosiloxane structural element present in the polycarbonate-, polyurethane- and/or polyurea-polyorganosiloxane compound has the structure —$(SiR^4{}_2O)_p$—$(SiR^4{}_2)$—, where $R^4$ is a linear, cyclic or branched, saturated, unsaturated or aromatic hydrocarbon radical with up to 20 carbon atoms and p=1 to 999.

3. The agent according to claim 1, wherein the polycarbonate-, polyurethane- and/or polyurea-polyorganosiloxane compound comprises at least two polyorganosiloxane units.

4. The agent according to claim 1, wherein at least one of the Y units according to the structural element of Formula (I) in the polycarbonate-, polyurethane- and/or polyurea-polyorganosiloxane compound has a —$NR^2$— group and/or at least one of the Y units according to the structural element of formula (I) has a —($N^+R^2R^3$)— group.

5. The agent according to claim 1, wherein oligoethoxy and/or oligopropoxy groups are present in at least one of the units Y, $R^1$, $R^2$ and/or $R^3$ according to the structural element of Formula (I), the oligoethoxy and/or oligopropoxy groups having degrees of oligomerization in the range of 2 to 60.

6. The agent according to claim 1, wherein at least one oligoethylene-imine group, having a degree of oligomerization in the range of 10 to 150,000, is present in at least one of the units Y, $R^1$, $R^2$ and/or $R^3$ according to the structural element of Formula (I).

7. The agent according to claim 1, wherein the polycarbonate- and/or polyurethane- polyorganosiloxane compound has at least one structural element of Formula (II) or Formula (III):

$$\text{-A-Y-A-(CO)—O—Z—(CHOH)—Z—O—(CO)—} \quad \text{(II)}$$

$$\text{-A-Y-A-(CO)—O—(CHCH}_2\text{OH)—Z—O—(CO)—} \quad \text{(III)}$$

in which A and Y have the meanings given in claim 1, and

Z is a divalent, linear, cyclic or branched, saturated or unsaturated, optionally substituted hydrocarbon radical with 1 to 12 carbon atoms.

8. The agent according to claim 1, comprising at least one nonionic surfactant of the general formula:

$$R^6\text{—CH(OH)CH}_2\text{O-(AO)}_w\text{-(A'O)}_x\text{-(A''O)}_y\text{-(A'''O)}_z\text{—}R^7\text{, in which}$$

$R^6$ stands for a linear or branched, saturated or mono- or polyunsaturated $C_{6-24}$ alkyl or alkenyl radical;

$R^7$ stands for a linear or branched hydrocarbon radical with 2 to 26 carbon atoms;

A, A', A'' and A''', independently of one another, stand for a radical selected from —$CH_2CH_2$, —$CH_2CH_2$—$CH_2$, —$CH_2CH_2(CH_3)$, —$CH_2$—$CH_2$—$CH_2$—$CH_2$, —$CH_2$—$CH(CH_3)$—$CH_2$—, or —$CH_2$—$CH(CH_2CH_3)$, w, x, y and z, independently of one another, stand for values between 0.5 and 120, where x, y and/or z may also be 0.

9. An automatic dishwashing agent, wherein the agent comprises:

a) 5 wt % to 60 wt % citrate and is phosphate-free or 15 wt % to 25 wt % phosphate; and b) at least one polycarbonate-, polyurethane- and/or polyurea-polyorganosiloxane compound, comprising at least one structural element of Formula (I):

$$\text{—Y-A-(C=O)-A-} \quad \text{(I)}$$

where each A is selected, independently, from S, O and $NR^1$,

Y is a divalent or polyvalent, linear, cyclic or branched, saturated, unsaturated or aromatic, substituted or unsubstituted hydrocarbon radical with up to 1000 carbon atoms (not counting the carbon atoms of a polyorganosiloxane unit that is optionally also present), which may contain one or more groups selected from —O—, —(CO)—, —NH—, —$NR^2$—, —($N^+R^2R^3$)— and a polyorganosiloxane unit with 2 to 1000 silicon atoms, $R^1$ is hydrogen or a linear, cyclic or branched, saturated, unsaturated or aromatic hydrocarbon radical with up to 40 carbon atoms, which may contain one or more groups selected from —O—, —(CO)—, —NH— and —$NR^2$—, $R^2$ is a linear, cyclic or branched, saturated, unsaturated or aromatic hydrocarbon radical with up to 40 carbon atoms, which may contain one or more groups selected from —O—, —(CO)— and —NH—, $R^3$ is a linear, cyclic or branched, saturated, unsaturated or aromatic hydrocarbon radical with up to 100 carbon atoms, which may contain one or more groups selected from —O—, —(CO)— and —NH— or is a divalent radical, which forms a cyclic structure within the radical Y, or one or both radicals A vicinal to Y together with the radical Y between them may form a heterocyclic radical containing nitrogen, and not all the radicals A and/or Y and/or $R^1$ and/or $R^2$ and/or $R^3$ indicated in formula (I) within the entire compound must be the same, with the provision that at least one of the radicals Y in the entire compound is a polyorganosiloxane unit with 2 to 1000 silicon atoms or an acid addition compound and/or salt thereof.

10. The agent according to claim 1, additionally comprising at least one clear rinse polymer which is a copolymer comprised of monomers selected from at least two of the following groups:

i) mono- and polyunsaturated carboxylic acids of the general formula $R^8(R^9)C{=}C(R^{10})COOH$, in which $R^8$ to $R^{10}$, independently of one another, stand for —H, —$CH_3$, a linear or branched, saturated alkyl radical with 2 to 12 carbon atoms optionally substituted with —$NH_2$, —OH and/or —COOH, a linear or branched, mono- or polyunsaturated alkenyl radical with 2 to 12 carbon atoms optionally substituted with —$NH_2$, —OH and/or —COOH, or for —COOH or —$COOR^4$, where $R^4$ is a saturated or unsaturated, linear or branched hydrocarbon radical with 1 to 12 carbon atoms;

ii) monomers of the general formula: $R^{11}(R^{12})C{=}C(R^{13})$—X—$R^{14}$, in which $R^{11}$ to $R^{13}$, independently of one another, stand for —H, —$CH_3$ or —$C_2H_5$, X stands for an optional spacer group, which is selected from —$CH_2$—, —C(O)O— or —C(O)—NH—, and $R^{14}$ stands for a linear or branched, saturated alkyl radical with 2 to 22 carbon atoms or an unsaturated radical with 6 to 22 carbon atoms;

iii) monomers containing sulfonic acid groups of the general formula:

$R^{15}(R^{16})C{=}C(R^{17})$—X'—$SO_3H$, in which $R^{15}$ to $R^{17}$, independently of one another, stand for —H, —$CH_3$, a linear or branched, saturated alkyl radical with 2 to 12 carbon atoms, a linear or branched, mono- or polyunsaturated alkenyl radical with 2 to 12 carbon atoms, alkyl or alkenyl radicals substituted with —$NH_2$, —OH or —COOH, or for COOH or $COOR^{18}$, where $R^{18}$ is a saturated or unsaturated, linear or branched hydrocarbon radical with 1 to 12 carbon atoms, and X' stands for an optional spacer group, which is selected from —$(CH_2)_n$—, where n=0 to 4, —COO—$(CH_2)_k$—, where k=1 to 6, —C(O)—NH—$C(CH_3)_2$— or —C(O)—NH—$CH(CH_2CH_3)$—;

iv) other ionic and/or nonionic monomers.

11. The agent according to claim 9, wherein the polyorganosiloxane structural element present in the polycarbonate-, polyurethane- and/or polyurea-polyorganosiloxane compound has the structure —$(SiR^4{}_2O)_p$—$(SiR^4{}_2)$—, where $R^4$ is a linear, cyclic or branched, saturated, unsaturated or aromatic hydrocarbon radical with up to 20 carbon atoms and p=1 to 999.

12. The agent according to claim 9, wherein the polycarbonate-, polyurethane- and/or polyurea-polyorganosiloxane compound comprises at least two polyorganosiloxane units.

13. The agent according to claim 9, wherein at least one of the Y units according to the structural element of Formula (I) in the polycarbonate-, polyurethane- and/or polyurea-polyorganosiloxane compound has a —$NR^2$— group and/or at least one of the Y units according to the structural element of formula (I) has a —$(N^+R^2R^3)$— group.

14. The agent according to claim 9, wherein oligoethoxy and/or oligopropoxy groups are present in at least one of the units Y, $R^1$, $R^2$ and/or $R^3$ according to the structural element of Formula (I), the oligoethoxy and/or oligopropoxy groups having degrees of oligomerization in the range of 2 to 60.

15. The agent according to claim 9, wherein at least one oligoethylene-imine group, having a degree of oligomerization in the range of 10 to 150,000, is present in at least one of the units Y, $R^1$, $R^2$ and/or $R^3$ according to the structural element of Formula (I).

16. The agent according to claim 9, wherein the polycarbonate- and/or polyurethane- polyorganosiloxane compound has at least one structural element of Formula (II) or Formula (III):

$$\text{-A-Y-A-(CO)—O—Z—(CHOH)—Z—O—(CO)—} \quad \text{(II)}$$

$$\text{-A-Y-A-(CO)—O—(CHCH}_2\text{OH)—Z—O—(CO)—} \quad \text{(III)}$$

in which A and Y have the meanings given in claim 1, and

Z is a divalent, linear, cyclic or branched, saturated or unsaturated, optionally substituted hydrocarbon radical with 1 to 12 carbon atoms.

17. The agent according to claim 9 additionally, comprising at least one nonionic surfactant of the general formula:

$R^6$—$CH(OH)CH_2O$-$(AO)_w$-$(A'O)_x$-$(A''O)_y$-$(A'''O)_z$-$R^7$, in which $R^6$ stands for a linear or branched, saturated or mono- or polyunsaturated $C_{6-24}$ alkyl or alkenyl radical;

$R^7$ stands for a linear or branched hydrocarbon radical with 2 to 26 carbon atoms;

A, A', A'' and A''', independently of one another, stand for a radical selected from —$CH_2CH_2$, —$CH_2CH_2$—$CH_2$, —$CH_2CH_2(CH_3)$, —$CH_2$—$CH_2$—$CH_2$—$CH_2$, —$CH_2$—$CH(CH_3)$—$CH_2$—, or —$CH_2$—$CH(CH_2CH_3)$, w, x, y and z, independently of one another, stand for values between 0.5 and 120, where x, y and/or z may also be 0.

18. The agent according to claim 9, additionally comprising at least one clear rinse polymer which is a copolymer comprised of monomers selected from at least two of the following groups:

i) mono- and polyunsaturated carboxylic acids of the general formula $R^8(R^9)C{=}C(R^{10})COOH$, in which $R^8$ to $R^{10}$, independently of one another, stand for —H, —$CH_3$, a linear or branched, saturated alkyl radical with 2 to 12 carbon atoms optionally substituted with —$NH_2$, —OH and/or —COOH, a linear or branched, mono- or polyunsaturated alkenyl radical with 2 to 12 carbon atoms optionally substituted with —$NH_2$, —OH and/or —COOH, or for —COOH or —$COOR^4$, where $R^4$ is a saturated or unsaturated, linear or branched hydrocarbon radical with 1 to 12 carbon atoms;

ii) monomers of the general formula: $R^{11}(R^{12})C{=}C(R_{13})$—X—$R_{14}$, in which $R^{11}$ to $R^{13}$, independently of one another, stand for —H, —$CH_3$ or —$C_2H_5$, X stands for an optional spacer group, which is selected from —$CH_2$—, —C(O)O— or —C(O)—NH—, and $R^{14}$ stands for a linear or branched, saturated alkyl radical with 2 to 22 carbon atoms or an unsaturated radical with 6 to 22 carbon atoms;

iii) monomers containing sulfonic acid groups of the general formula:

$R^{15}(R^{16})C{=}C(R^{17})$—X'—$SO_3H$, in which $R^{15}$ to $R^{17}$, independently of one another, stand for —H, —$CH_3$, a linear or branched, saturated alkyl radical with 2 to 12 carbon atoms, a linear or branched, mono- or polyunsaturated alkenyl radical with 2 to 12 carbon atoms, alkyl or alkenyl radicals substituted with —$NH_2$, —OH or —COON, or for COOH or $COOR^{18}$, where $R^{18}$ is a saturated or unsaturated, linear or branched hydrocarbon radical with 1 to 12 carbon atoms, and X' stands for an optional spacer group, which is selected from —$(CH_2)_n$—, where n=0 to 4, —COO—$(CH_2)_k$—, where k=1 to 6, —C(O)—NH—$C(CH_3)_2$— or —C(O)—NH—$CH(CH_2CH_3)$—;

iv) other ionic and/or nonionic monomers.

19. The agent according to claim 9, additionally comprising:

c. 2 to 8 wt % nonionic surfactant(s);

d). 4 to 16 wt % polymer(s);

e). 2 to 15 wt % sodium percarbonate; and f). 1 to 6 wt % enzyme(s).

20. The agent according to claim 9, comprising 0.01 wt % to 5 wt % polycarbonate-, polyurethane- and/or polyurea-polyorganosiloxane compound, or acid addition compound, and/or salt thereof.

21. The agent according to claim 9, additionally comprising 1 wt % to 10 wt nonionic surfactant.

* * * * *